US010221680B2

(12) United States Patent
August et al.

(10) Patent No.: US 10,221,680 B2
(45) Date of Patent: Mar. 5, 2019

(54) UNDERWATER HYDROCARBON EXTRACTION FACILITY

(71) Applicant: GE Oil & Gas UK Limited, Nailsea, Bristol (GB)

(72) Inventors: Charles Anthony August, Nailsea (GB); Robert Dalziel, Nailsea (GB)

(73) Assignee: GE OIL & GAS UK LIMITED, Bristol (GB)

( * ) Notice: Subject to any disclaimer, the term of this patent is extended or adjusted under 35 U.S.C. 154(b) by 0 days.

(21) Appl. No.: 15/558,220

(22) PCT Filed: Mar. 14, 2016

(86) PCT No.: PCT/EP2016/055472

§ 371 (c)(1),
(2) Date: Sep. 14, 2017

(87) PCT Pub. No.: WO2016/146593

PCT Pub. Date: Sep. 22, 2016

(65) Prior Publication Data

US 2018/0045039 A1 Feb. 15, 2018

(30) Foreign Application Priority Data

Mar. 17, 2015 (GB) ..... 1504480.3

(51) Int. Cl.
*E21B 33/035* (2006.01)
*E21B 34/04* (2006.01)
*E21B 47/12* (2012.01)

(52) U.S. Cl.
CPC ..... *E21B 47/12* (2013.01); *E21B 33/0355* (2013.01); *E21B 34/04* (2013.01); *E21B 47/122* (2013.01)

(58) Field of Classification Search
CPC .. E21B 33/035; E21B 33/0355; E21B 33/043; E21B 33/064; E21B 34/04; E21B 47/12; E21B 47/122
See application file for complete search history.

(56) References Cited

U.S. PATENT DOCUMENTS 6,257,549 B1 * 7/2001 Hopper ..... E21B 33/0355 166/363
6,420,976 B1 * 7/2002 Baggs ..... E21B 33/0355 166/250.15
6,595,487 B2 * 7/2003 Johansen ..... E21B 33/0355 251/129.04
8,281,863 B2 * 10/2012 Voss ..... F16K 3/0254 166/332.4
8,686,681 B2 * 4/2014 Stale ..... E21B 33/0355 320/101
8,789,606 B1 * 7/2014 Lugo ..... E21B 33/064 166/250.15
9,622,367 B2 * 4/2017 Carter ..... E21B 33/0355
(Continued)

FOREIGN PATENT DOCUMENTS

EP 0 704 779 A1 4/1996
EP 2 474 704 A1 7/2012
(Continued)

OTHER PUBLICATIONS

Search Report issued in connection with corresponding GB Application No. 1504480.3 dated May 15, 2015.
(Continued)

*Primary Examiner* — Matthew R Buck
(74) *Attorney, Agent, or Firm* — GE Global Patent Operation

(57) ABSTRACT

An underwater hydrocarbon extraction facility including a plurality of actuators wherein each of the actuator includes: an electric motor arranged to operate the actuator; communication means configured to receive communication signals; and a controller connected to the communication means and the electric motor, said controller being operable to activate the electric motor in response to a received communication signal.

24 Claims, 2 Drawing Sheets

(56) References Cited

U.S. PATENT DOCUMENTS

| | | | | |
|---|---|---|---|---|
| 2005/0179263 | A1 | 8/2005 | Johansen et al. | |
| 2006/0086497 | A1 | 4/2006 | Ohmer et al. | |
| 2006/0102357 | A1 | 5/2006 | Williams | |
| 2008/0264646 | A1* | 10/2008 | Sten-Halvorsen | E21B 33/0355 166/360 |
| 2009/0038804 | A1* | 2/2009 | Going, III | E21B 33/0355 166/335 |
| 2010/0019930 | A1 | 1/2010 | Biester et al. | |
| 2011/0215747 | A1 | 9/2011 | Saruwatari et al. | |
| 2012/0088134 | A1* | 4/2012 | Wood | E21B 33/064 429/90 |
| 2014/0131049 | A1 | 5/2014 | Bourgeau | |

FOREIGN PATENT DOCUMENTS

| | | | | |
|---|---|---|---|---|
| GB | 2 264 737 | A | 9/1993 | |
| GB | 2 332 220 | A | 6/1999 | |
| GB | 2 364 396 | A | 1/2002 | |
| GB | 2387977 | A * | 10/2003 | E21B 33/0355 |
| GB | 2480427 | A | 11/2011 | |
| GB | 2476740 | B | 10/2012 | |
| GB | 2480973 | B | 5/2013 | |
| WO | 2007/027080 | A2 | 3/2007 | |
| WO | 2012/041531 | A2 | 4/2012 | |
| WO | 2014/105420 | A2 | 7/2014 | |
| WO | 2014/123540 | A1 | 8/2014 | |

OTHER PUBLICATIONS

Invitation to pay Additional Fees issued in connection with corresponding PCT Application No. PCT/EP2016/055472 dated Jun. 9, 2016.

International Search Report and Written Opinion issued in connection with corresponding PCT Application No. PCT/EP2016/055472 dated Sep. 16, 2016.

International Preliminary Report on Patentability issued in connection with corresponding PCT Application No. PCT/EP2016/055472 dated Sep. 19, 2017.

* cited by examiner

UNDERWATER HYDROCARBON EXTRACTION FACILITY

FIELD OF INVENTION

Embodiments of the present invention relate generally to underwater hydrocarbon extraction facility, and a method of controlling an actuator in an underwater hydrocarbon extraction facility.

BACKGROUND OF THE INVENTION

The oil and gas industry is increasingly moving towards all-electric arrangements for underwater hydrocarbon extraction facilities (for example, by using electrically operated actuators). 'All-electric' refers to systems where some, or all, of the hydraulically driven components are instead driven by electrical means. Prior art underwater extraction facilities relied on a subsea control module (SCM) to act as a centralised controller for electrical and hydraulic actuators in an underwater hydrocarbon extraction facility. However, an all-electric arrangement, the requirements on the SCM are less rigid and control of the actuators can be distributed rather than centralised.

As prior art there may be mentioned:

U.S. Pat. No. 6,595,487, which discloses an electric actuator with primary and secondary sources of power;

EP0704779, which discloses a device for controlling hydraulically-actuated oil well head valves;

GB2264737, which discloses the remote control of hydraulically operated valves;

WO2014105420, which discloses a method of providing power to subsea sensors;

EP2474704, which discloses a method of monitoring a subsea sensor;

GB2480973, which discloses a subsea control module that can communicate with a plurality of sensors wirelessly;

GB2476740, which discloses a controller with acoustic and optical communication means; and US20110215747, which discloses a module for supplying electrical power to an actuator in the event of a power failure.

It is an aim of embodiments of the present invention to overcome drawbacks associated with prior art actuators.

SUMMARY OF INVENTION

In accordance with a first aspect of the present invention there is provided an underwater hydrocarbon extraction facility including a plurality of actuators, wherein each of the actuators comprises: an electric motor arranged to operate the actuator; communication means configured to receive communication signals; and a controller connected to the communication means and the electric motor, said controller being operable to activate the electric motor in response to a received communication signal.

In accordance with a second aspect of the present invention there is provided a method of operating an actuator in an underwater hydrocarbon extraction facility, said actuator comprising an electric motor arranged to operate the actuator, the method comprising the steps of: providing a communication means configured to receive communication signals at the actuator; providing a controller connected to the communication means and the electric motor; and transmitting a communication signal to the communication means to cause the controller to activate the electric motor.

The electric motor, communication means and controller of at least one of the actuators could be retrievable. Alternatively, the electric motor, communication means and controller of at least one of the actuators could be integral to the actuator.

The electric motor of at least one of the actuators could be configured to receive power from a power and communications line.

At least one of the actuators could comprise a local energy storage means in electrical communication with its electric motor.

The communication means of at least one of the actuators could be configured to communicate with a sensor. Communication between said communication means and the sensor could be wireless. Alternatively or additionally, communication between said communication means and the sensor could be through a wired connection.

The communication means of at least one of the actuators could be configured to communicate with the communication means of at least one of the other actuators in the facility. In this case, the communication between the communication means of at least one of the actuators and the communication means of at least one of the other actuators in the facility could be wireless. Alternatively or additionally, the communication between the communication means of at least one of the actuators and the communication means of at least one of the other actuators in the facility could be through a wired connection.

The communication means of at least one of the actuators could comprise a modem card.

BRIEF DESCRIPTION OF THE DRAWINGS

Various embodiments of embodiments of the invention will now be described with reference to the accompanying drawings, in which.

DETAILED DESCRIPTION

Figure 1:
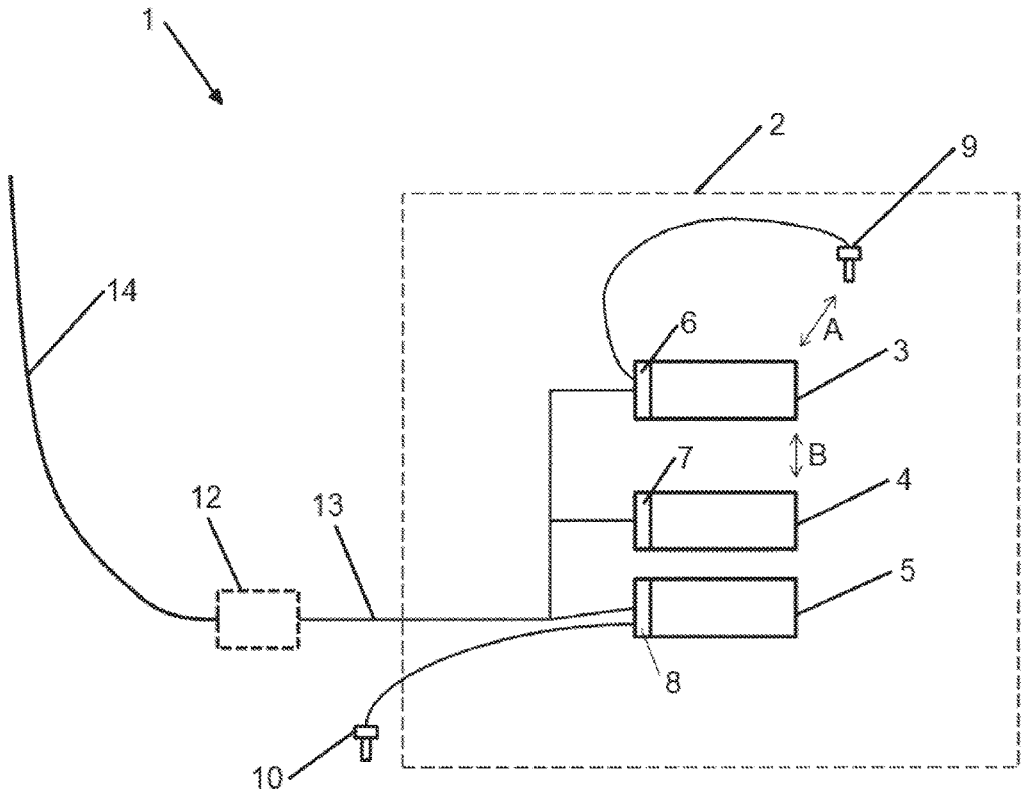
FIG. 1 schematically shows a control arrangement of an underwater hydrocarbon.

FIG. 1 shows a control arrangement 1 of an underwater hydrocarbon extraction facility. The arrangement 1 comprises a subsea structure 2. In the embodiment of FIG. 1 the subsea structure is a Christmas tree at a subsea well. The Christmas tree has a plurality of control valves which are operable by actuators. To illustrate embodiments of the present invention three actuators 3, 4, 5 are shown in FIG. 1.

Each actuator 3, 4, 5 has its own respective power and communications module 6, 7, 8. Each power and communications module 6, 7, 8 comprises an electric motor, a communications means and a controller.

Each electric motor is arranged to operate its respective actuator. Each communication means is configured to receive a communications signal. Suitable communication means are generally well-known in the art. For example, a modem incorporating a modem card could be used.

Each controller is electrically connected to its respective communication means and electric motor, and is operable to activate the respective electric motor in response to a received communication signal at the respective communication means.

In the embodiment of FIG. 1 each power and communications module 6, 7, 8 further comprises a local energy storage means (such as a battery or supercapacitor) from which the electric motor can receive electrical power.

The power and communications modules 6, 7, 8 of FIG. 1 are all retrievable. This allows maintenance to be easily performed if a component of a power and communications module fails. Alternatively, the power and communications modules 6, 7, 8 could be formed integrally with their respective actuators.

The three power and communications modules 6, 7, 8 are connected to a distributed communications controller 12 through a wired connection 13. Each power and communications module 6, 7, 8 receives electrical power and communications signals through the wired connection 13. As the power and communications modules 6, 7, 8 in FIG. 1 each comprises a local energy storage means, the electrical power received from the wired connection 13 can be used to charge the respective local energy storage means or to power the respective electric motor directly. The distributed communications controller 12 is in communication with a topside control centre (not shown) via an umbilical 14, which runs from the surface of the water to the sea bed.

In alternative embodiments, the distributed communications controller 12 is removed entirely and the subsea sensors and actuators receive electrical power and communication signals directly from the topside control centre.

The actuator 3 is in wired communication with an on-structure sensor 9. Christmas trees generally have numerous on-structure sensors to monitor, for example, temperature and pressure of production fluid. As the actuator 3 comprises its own communication means in the power and communications module 6, readings from the on-structure sensor 9 can be relayed to the topside control centre directly from the power and communications module 6 without the need for processing in a centralised subsea electronics module.

As indicated by the two-way arrow A, the actuator 3 is also in wireless communication with the on-structure sensor 9. To achieve this, the communication means in the power and communications module 6 includes a wireless communication means using, for example, wi-fi, Bluetooth® or other wireless communication protocol, or acoustic communications. This wireless communication can be used in conjunction with the wired connection to provide a redundant communication path, or it can be used instead of a wired connection, where it is technically unfeasible or inconvenient to use a wired connection.

The actuator 5 is in wired communication with an off-structure sensor 10. Underwater hydrocarbon extraction facilities generally have numerous off-structure sensors to monitor, for example, seismic activity of the sea bed. As the actuator 5 comprises its own communication means in the power and communications module 8, readings from the off-structure sensor 10 can be relayed to the topside control centre directly from the power and communications module 8 without the need for processing in a centralised subsea electronics module.

As indicated by the two-way arrow B, actuators 3 and 4 are also in wireless communication with one another. This is achieved using wireless communication means in the power and communications modules 6 and 7, as described above. This wireless communication provides an alternative emergency communication path between the topside control centre and an actuator. For example, if the wired connection 13 became severed in the vicinity of actuator 3, a communication signal could still be passed to the actuator 3 by sending a communication signal to the power and communications module 7 of actuator 4, said communication signal including a command to wirelessly transmit the communication signal to the power and communications module 6.

Figure 2A:
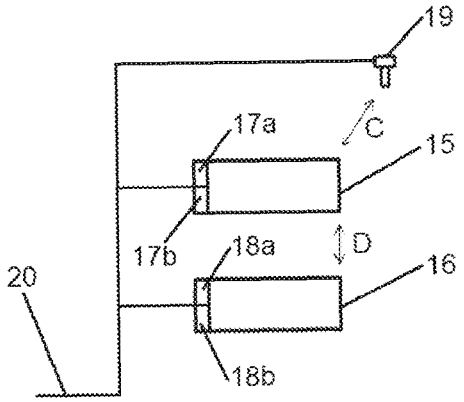
FIGS. 2A, 2B and 2C schematically show two actuators for use in an underwater hydrocarbon extraction facility.

FIG. 2*a* schematically shows a pair of actuators 15 and 16 for use in an underwater hydrocarbon extraction facility according to an embodiment of the invention. Actuators 15 and 16 operate valves in the underwater hydrocarbon extraction facility (not shown).

Figure 2B:
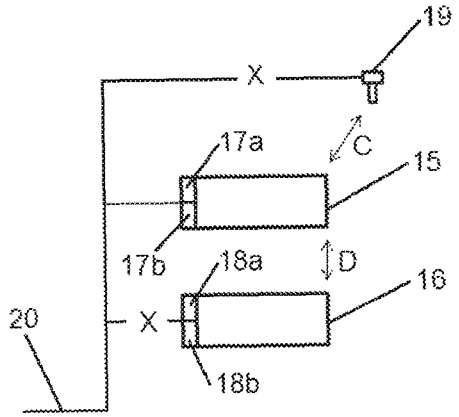
Figure 2C:
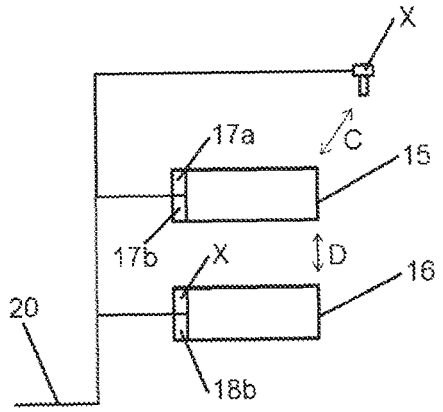

Actuator 15 has a power and communications module. In FIGS. 2*a-c* the power and communications module of actuator 15 is shown divided into two parts. Part 17*a* contains a long-range communication means (e.g. a modem card) for two-way communication between the power and communications module and a topside control centre. Part 17*b* contains a short-range communication means (e.g. a Bluetooth® device) for two-way wireless communication between the power and communications module and sensors and/or other actuators at the sea bed. The power and communications module of actuator 15 also comprises an electric motor and a controller (not shown).

Actuator 16 also has a power and communications module. In FIGS. 2*a-c* the power and communications module of actuator 16 is shown divided into two parts. Part 18*a* contains a long-range communication means (e.g. a modem card) for two-way communication between the power and communications module and a topside control centre. Part 18*b* contains a short-range communication means (e.g. a Bluetooth® device) for two-way wireless communication between the power and communications module and sensors and/or other actuators at the sea bed. The power and communications module of actuator 16 also comprises an electric motor and a controller (not shown).

Each electric motor is arranged to operate its respective actuator. Each communication means is configured to receive a communications signal. Suitable long-range and short-range communication means are generally well-known in the art.

Each controller is electrically connected to its respective communication means and electric motor, and is operable to activate the respective electric motor in response to a received communication signal at the respective communication means.

Each power and communications module receives electrical power and communications signals through the wired connection 20. Each power and communications module comprises a local energy storage means, and the electrical power received from the wired connection 20 can be used to charge the respective local energy storage means or to power the respective electric motor directly.

A sensor 19 of the underwater hydrocarbon extraction facility also receives electrical power and communications signals via the wired connection 20. The sensor 19 also comprises a power and communications module, however unlike the power and communications modules of the actuators 15, 16, the power and communications module of the sensor 19 only comprises a communication means and an energy storage means. No controller or electric motor is required. The energy storage means of the power and communications module may be charged by electrical power received from the wired connection 20. Like the power and communications modules of the actuators 15, 16, the power and communications module of the sensor 19 contains a long-range communication means (e.g. a modem card) for two-way communication between the power and communications module of the sensor and a topside control centre. The power and communications module of the sensor 19 also contains a short-range communication means (e.g. a Bluetooth® device) for two-way wireless communication between the power and communications module and actuators and/or other sensors at the sea bed.

The wired connection 20 is connected to a topside control centre via an umbilical (not shown). In the embodiment of FIGS. 2*a-c*, no distributed communications controller is present, and the two-way communication is enabled between the topside control centre and the sensor 19 and the actuators 15, 16 using only the long-range communication means present in their respective power and communications modules. Readings from the sensor 19 may be transmitted directly to the topside control centre via the wired connection 20. Additionally, two-way wireless communication is enabled between the sensor 19 and the actuator 15 via the short-range communication means present in their respective power and communications modules as indicated by arrow C. Two-way wireless communication is enabled between the actuator 15 and the actuator 16 via the short-range communication means present in their respective power and communications modules as indicated by arrow D.

FIG. 2*b* shows the arrangement of FIG. 2*a* having undergone a hardware failure. Like reference numerals have been retained where appropriate.

In FIG. 2*b* the wired connection 20 has been severed at the points indicated by an X, i.e. in a region proximate the sensor 19 and proximate the actuator 16. The wired connection has not been severed and is still unbroken between the topside control centre and the actuator 15.

In this case the sensor 19 can still operate by drawing electrical power from the local energy storage means in its power and communications module. Sensor readings can be relayed to the topside control centre by transmitting the readings to the actuator 15 using the wireless communication indicated by arrow C. Sensor readings transmitted to the actuator 15 can be forwarded to the topside control centre via wired connection 20 using the long-range communication means in the power and communications module of the actuator 15. The sensor 19 can only continue to operate for a limited time as the local energy storage means in its power and communications module cannot now be charged from the wired connection 20. However, this limited duration of emergency operation is still useful as the wired connection 20 may be repaired before the local energy storage means is depleted, resulting in continuous operation.

Also in this case, the actuator 16 can still be operated from the topside control centre. A communication signal intended for the actuator 16 can be transmitted from the topside control centre to the long-range communication means in the power and communications module of the actuator 15. The communication signal can then be forwarded to the communication means of the power and communications module of the actuator 16 using the wireless communication indicated by arrow D. The actuator 16 can only continue to operate for a limited time as the local energy storage means in its power and communications module cannot now be charged from the wired connection 20. However, this limited duration of emergency operation is still useful as the wired connection 20 may be repaired before the local energy storage means is depleted, resulting in continuous operation. Additionally, even if there is only enough electrical power in the local energy storage means for one operation of the actuator 16 after the severing of the wired connection 20 this may be crucial in shutting down production of the underwater hydrocarbon extraction facility in an emergency situation.

FIG. 2*c* shows the arrangement of FIG. 2*a* having undergone a hardware failure. Like reference numerals have been retained where appropriate.

In FIG. 2*c* a hardware failure has occurred at the points indicated by an X, i.e. there has been an electronics failure in the long-range communication means of the power and communications module of the sensor 19 and there has been an electronics failure in the long-range communication means of the power and communications module of the actuator 16. Both the long- and short-range communication means of the power and communications module of the actuator 15 are still functioning.

In this case the readings from the sensor 19 can still be relayed to the topside control centre by transmitting the readings to the actuator 15 using the wireless communication indicated by arrow C. Sensor readings transmitted to the actuator 15 can be forwarded to the topside control centre via wired connection 20 using the long-range communication means in the power and communications module of the actuator 15.

Also in this case, the actuator 16 can still be operated from the topside control centre. A communication signal intended for the actuator 16 can be transmitted from the topside control centre to the long-range communication means in the power and communications module of the actuator 15. The communication signal can then be forwarded to the communication means of the power and communications module of the actuator 16 using the wireless communication indicated by arrow D.

Embodiments of the present invention may provide many advantages. For example, increased potential communication paths between a topside control centre and an actuator in the underwater hydrocarbon extraction facility.

Certain aspects of embodiments of the present invention may also remove the need for a centralised subsea electronics module (SEM). Such a component was a point of weakness for prior art systems, as failure of the SEM could result in the loss of actuator control, and hence valve control, for the entire Christmas tree. Removal of this component also allows the size and weight of subsea structures to be reduced, and less Christmas trees to be designed. Removal of a centralised SEM also represents a significant cost saving, as the communication means replacing the SEM (e.g. modem cards) can be purchased very cheaply.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An actuator assembly in an underwater hydrocarbon extraction facility having a plurality of actuators, the actuator assembly comprising:

an electric motor arranged to operate at least one of the plurality of actuators;

a communicator configured to receive communication signals; and a controller connected to the communicator and the electric motor, said controller being operable to activate the electric motor in response to a received communication signal, wherein the communicator of the at least one of the plurality of actuators is configured to communicate directly with a communicator of another of the plurality of actuators, without the need for processing in a centralized processing module.

2. The actuator assembly according to claim 1, wherein the electric motor, communicator and controller of the at least one of the plurality of actuators are retrievable.

3. The actuator assembly according to claim 1, wherein the electric motor, communicator and controller of the at least one of the plurality of actuators are integral to the another of the plurality of actuators.

4. The actuator assembly according to claim 1, wherein the electric motor of the at least one of the plurality of actuators is configured to receive power from a power and communications line.

5. The actuator assembly according to claim 1, wherein the electric motor of the at least one of the plurality of actuators is in electrical communication with a local energy storage.

6. The actuator assembly according to claim 1, wherein the communicator of the at least one of the plurality of actuators is configured to communicate with a sensor.

7. The actuator assembly according to claim 6, wherein communication between said communicator and the sensor is wireless.

8. The actuator assembly according to claim 6, wherein communication between said communicator and the sensor is through a wired connection.

9. The actuator assembly according to claim 1, wherein the communication between the communicator of the at least one of the plurality of actuators and the communicator of the another of the plurality of actuators is wireless.

10. The actuator assembly according to claim 1, wherein the communication between the communicator of the at least one of the plurality of actuators and the communicator of the another of the plurality of actuators is through a wired connection.

11. The actuator assembly according to claim 1, wherein the communicator of the at least one of the plurality of actuators comprises a modem card.

12. The actuator assembly according to claim 1, wherein the actuator assembly is housed in an underwater hydrocarbon extraction facility.

13. A method of operating an actuator assembly in an underwater hydrocarbon extraction facility, said actuator assembly comprising an electric motor arranged to operate at least one actuator, the method comprising the steps of:

providing a communicator in the underwater hydrocarbon extraction facility configured to receive communication signals at the at least one actuator;

providing a controller connected to the communicator and the electric motor; and transmitting a communication signal to the communicator to cause the controller to activate the electric motor, wherein the communicator of the at least one actuator is configured to communicate directly with a communicator of a second actuator within the actuator assembly, without the need for processing in a central processing module.

14. The method according to claim 13, wherein the electric motor, the communicator of at least one of the at least one actuator or the second actuator, and the controller are retrievable.

15. The method according to claim 13, wherein the electric motor, the communicator of at least one of the at least one actuator or the second actuator, and the controller are integral to the respective actuator.

16. The method according to claim 13, wherein the electric motor is configured to receive power from a power and communications line.

17. The method according to claim 13, further comprising a local energy storage in electrical communication with the electric motor.

18. The method according to claim 13, wherein the communicator of at least one of the at least one actuator or the second actuator is configured to communicate with a sensor.

19. The method according to claim 18, wherein communication between the communicator of at least one of the at least one actuator or the second actuator and the sensor is wireless.

20. The method according to claim 18, wherein communication between the communicator of at least one of the at least one actuator or the second actuator and the sensor is through a wired connection.

21. The method according to claim 13, wherein the communicator of the at least one actuator is configured to communicate with the second actuator.

22. The method according to claim 21, wherein communication between the communicator of the at least one actuator and the second actuator is wireless.

23. The method according to claim 21, wherein communication between the communicator of the at least one actuator and the second actuator is through a wired connection.

24. The method according to claim 13, wherein the communicator of the at least one actuator or the second actuator comprises a modem card.

* * * * *